US006421520B2

(12) United States Patent
Masuda et al.

(10) Patent No.: US 6,421,520 B2
(45) Date of Patent: Jul. 16, 2002

(54) DEVELOPING APPARATUS HAVING MAGNETIC LOWER LIMIT DOMAIN BETWEEN REPULSION MAGNETIC FIELDS

(75) Inventors: Koji Masuda, Numazu; Shigeo Kimura, Mishima; Takao Ogata, Susono; Kazuhiro Hasegawa, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/757,620

(22) Filed: Jan. 11, 2001

(30) Foreign Application Priority Data

Jan. 13, 2000 (JP) ..... 2000-004960

(51) Int. Cl.[7] ..... G03G 15/09
(52) U.S. Cl. ..... 399/277
(58) Field of Search ..... 399/275, 277; 430/122

(56) References Cited

U.S. PATENT DOCUMENTS 5,044,313 A * 9/1991 Yuga et al. ..... 399/277 X
5,253,018 A 10/1993 Takeuchi et al.
5,469,244 A 11/1995 Ogata et al.
5,559,587 A 9/1996 Ogata et al.
5,697,010 A 12/1997 Masuda et al.
5,999,777 A 12/1999 Masuda et al.
6,067,433 A 5/2000 Kimura et al.
6,075,954 A 6/2000 Ogata et al.
6,081,684 A * 6/2000 Haganuma et al. ..... 399/275

FOREIGN PATENT DOCUMENTS

JP 4-199168 * 7/1992
JP 11-311904 11/1999

* cited by examiner

*Primary Examiner*—Joan Pendegrass
(74) *Attorney, Agent, or Firm*—Fitzpatrick, Cella, Harper & Scinto

(57) ABSTRACT

When the structure is arranged such that one of the repulsion poles is used as a developer layer thickness regulation pole, screw pitch-shaped density unevenness occurred at the rear end of a solid black image. To provide a developing apparatus, comprising a developing container containing developer including magnetic carrier and non-magnetic toner, a developer bearing body provided at an opening of the developer container, for rotating while bearing the developer, a magnet member provided within the developer bearing body, the magnet member having a first magnetic pole, and a second magnetic pole adjacent on the downstream side of the developer bearing body of the first magnetic pole in a direction of rotation thereof, having a second magnetic pole having the same polarity as the first magnetic pole, a regulating member provided in the vicinity of the second magnetic pole, for regulating an amount of developer on the developer bearing body, in which between the first magnetic pole and the second magnetic pole, there exists 40° or more an area having 8 mT or less in magnetic flux density in the direction of the normal to the surface of the developer bearing body.

7 Claims, 4 Drawing Sheets

DEVELOPING APPARATUS HAVING MAGNETIC LOWER LIMIT DOMAIN BETWEEN REPULSION MAGNETIC FIELDS

BACKGROUND OF THE INVENTION

1. Field of the Invention

The present invention relates to a developing apparatus to be used for an image forming apparatus using an electrophotographic system or an electrostatic recording system, and more particularly to a developing apparatus using two-component developer including carrier and toner.

2. Related Background Art

Conventionally, various types of image forming apparatuses of the electropotographic type have been proposed and put to practical use. The image forming apparatus has developed an electrostatic latent image formed on an image bearing body by a developing apparatus for visualization, and this developing is generally divided into a single-component developing method and a two-component developing method.

Most of the single-component developing method uses the non-contact system, and as a typical developing method of the single-component developing method, there is a single-component jumping developing method using magnetic toner. This developing method is capable of obtaining a high quality image in an easy developing apparatus configuration. But it has a disadvantage that any color image cannot be obtained since toner contains magnetic substance. On the other hand, the single-component developing method using non-magnetic toner is capable of obtaining a color image, but it is difficult to apply toner to a developing sleeve of the developing apparatus. It is currently coated through the use of an elastic blade, and this method lacks stability and durability.

In contrast, the two-component developing method is to convey toner to a developing unit through the use of a magnetic carrier for developing, and the developer is normally caused to come into contact with a photosensitive drum for developing. With reference to FIG. 5, the description will be made of the developing process.

As shown in FIG. 5, the developing apparatus is configured by providing a developing container 34 containing developer with a developing sleeve 30 comprising a magnet roller 35 disposed so as not to rotate, conveying screws 31 and 32, and a regulating blade 33. The description will be made of a process for developing an electrostatic latent image on the photosensitive drum 3 in accordance with the two-component magnetic brush method through the use of this developing apparatus, and circulation of the developer at the time hereinafter.

First, the developer, which has been conveyed through the use of the conveying screws 32 and 31 and attracted on the surface of the developing sleeve 3 by a magnetic pole N3 of the magnet roller 35, is conveyed to N3 pole→S2 pole→N1 pole with the rotation of the developing sleeve 30, is regulated by the regulating blade 33 in the process, and is formed into a thin layer of developer on the developing sleeve 30. When the developer formed into the thin layer is conveyed to a developing main pole S1 of a magnet roller 35 located in a developing unit in which the photosensitive drum 3 and the developing sleeve 30 are opposed to each other, a magnetic force causes the developer to stand on the surface of the developing sleeve 30 like ear, and the developer formed into an ear shape comes into contact with the surface of the photosensitive drum 3, and develops the electrostatic latent image on the photosensitive drum 3 to visualize it as a toner image.

The developer after the development is completed in the developing unit is returned into a developing container 34 with the rotation of the developing sleeve 30, and is separated from the developing sleeve 30 by means of a repulsion magnetic field to be formed by magnetic poles N3 and N2 of the magnet roller 35 to be collected within the developing container 34.

As described above, in the two-component developing method, the structure is generally arranged such that magnetic poles having the same polarity are arranged side by side, and developer after development is removed from the developing sleeve once so as not to leave any image history on the developing sleeve.

As a method for forming an electrostatic latent image, there has been known a method for exposing and scanning the surface of the photosensitive drum 3 through the use of a laser beam modulated correspondingly to an image signal to be recorded to form into a dot-shaped latent image obtained by bringing a shape of distributed dots into correspondence with an image. Of these methods, a so-called pulse width modulation (PWM) method for modulating a width (that is, duration) of laser driving pulse current correspondingly to density of a non-recorded image is capable of obtaining high recording density (that is, high resolution), and obtaining high gradation.

In recent years, in an image forming apparatus using the two-component developing apparatus, further miniaturization, higher image quality and extension of the life have been advanced. Of these, in order to attain extension of the life of the developing apparatus, it is necessary to arrange the structure such that the developer is not compressed and to prevent toner and carrier from being deteriorated.

A place where the developer is compressed within the developing container 34 is a developer regulating unit, and according to an ordinary configuration of the developing apparatus, a developer layer thickness regulation pole S2 of the magnet roller 30 is positioned upstream of the regulating blade 30 in the direction of rotation of the developing sleeve 30, and the developer attracted to the regulation pole S2 is compressed between the developing sleeve 30 and the container 34 in this domain.

In order to weaken the compression of developer, it is effective to weaken a force, magnetic attraction force working in a direction perpendicular to the surface of the developing sleeve 30, by which the developer layer thickness regulation pole S2 is attracting the developer to the developing sleeve 30.

As a method for weaking the magnetic attraction force, there are a method for reducing magnetization of magnetic carrier in the developer, or constructing such a magnet pattern as to appear perpendicularly from the surface of the developing sleeve 30 as far as possible and so on because it is difficult for a line of magnetic force from the developer layer thickness regulation pole S2 to go round to magnetic poles N3 and N1 adjacent. In the above method for reducing magnetization of magnetic carrier a direction for reducing this carrier magnetization is an advantageous direction to improve the image quality at a point where a force for slidably contacting the toner image developed on the photosensitive drum in the developing unit becomes weak.

As one of the latter methods using a magnet pattern, there has been proposed a developing method for using one of repulsion magnetic fields of developing sleeve as the developer layer thickness regulation pole (Japanese Patent Application Laid-Open No. 11-311904). When magnetic poles having the same polarity are adjacent to each other to form a repulsion magnetic field, the line of magnetic force from each magnetic pole emanates perpendicularly to the surface of the developing sleeve, and a rate of change in magnetic flux density in a direction perpendicular to the surface of the developing sleeve is small. As a result, a force which attracts the developer to the developing sleeve becomes small to weaken the compression of the developer.

However, when the structure is arranged such that one of such repulsion poles as described above is used as a developer layer thickness regulation pole, screw pitch-shaped density unevenness occurred at the rear end of a solid black image.

This phenomenon occurs when a mixture ratio between developer having an image history after development which could not be removed by the repulsion magnetic field and developer supplied to the developer layer thickness regulation pole S2 after agitated and conveyed by a conveying screw 31 is changed by a rotational period of the screw in an image longitudinal domain. Also, this phenomenon also easily occurs when the magnetic carrier is less magnetized. This is because when less magnetized, the developer becomes insensitive to the magnetic field, and the developer after the development cannot be removed with a scraping pole, but is prone to move to the developer layer thickness regulation pole S2.

SUMMARY OF THE INVENTION

It is an object of the present invention to provide a developing apparatus using one of magnetic poles for forming the repulsion magnetic field as a developer amount regulation pole.

It is another object of the present invention to provide a developing apparatus which is not affected by a pitch of an agitating screw.

It is still another object of the present invention to provide a developing apparatus, including:

- a developing container containing developer including magnetic carrier and non-magnetic toner;
- a developer bearing body provided at an opening of the developer container, for rotating while bearing the developer;
- a magnet member provided within the developer bearing body, the magnet member having a first magnetic pole, and a second magnetic pole adjacent on the downstream side of the developer bearing body of the first magnetic pole in a direction of rotation thereof, having a second magnetic pole having the same polarity as the first magnetic pole; and
- a regulating member provided in the vicinity of the second magnetic pole, for regulating an amount of developer on the developer bearing body,
- in which between the first magnetic pole and the second magnetic pole, there exists 40° or more a domain having 8 mT or less in magnetic flux density in the direction of the normal to the surface of the developer bearing body.

Further objects of the present invention will be apparent from the following description.

DESCRIPTION OF THE PREFERRED EMBODIMENTS

Hereinafter, with reference to the drawings, the description will be made of embodiments of the present invention.

(First Embodiment)

Figure 1:
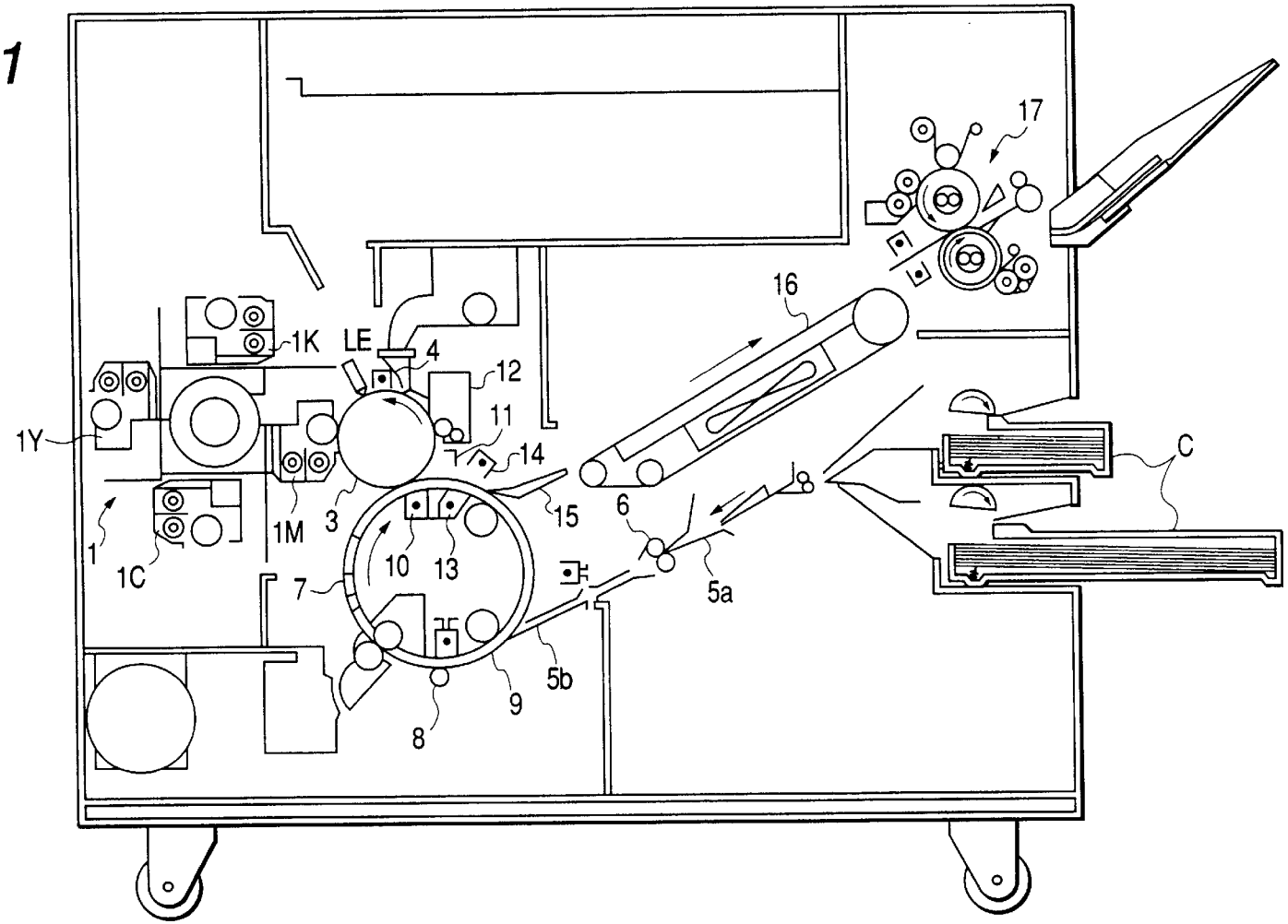
FIG. 1 is a cross sectional view showing an image forming apparatus according to an embodiment of the present invention.

FIG. 1 is a cross sectional view showing an image forming apparatus according to an embodiment of the present invention. The present image forming apparatus is configured as a color printer of the electrophotographic type.

The present printer has an electrophotographic photosensitive body which rotates in a direction indicated by an arrow as an image bearing body, that is, a photosensitive body 3, and around the photosensitive drum 3, there are provided a charger 4, a rotational developing apparatus 1, a transferring discharger 10 and cleaning means 12, there is provided LED exposure means LE above the photosensitive drum 3, and image forming means is configured by these charger 4 to exposure means LE or the like.

The rotational developing apparatus 1 has four developing apparatuses 1M, 1C, 1Y and 1K, each of which contains two-component developer including toner and magnetic carrier. The developer in the developing apparatus 1M contains magenta toner, the developer in the developing apparatus 1C contains cyan toner, the developer in the developing apparatus 1Y contains yellow toner, and the developer in the developing apparatus 1K contains black toner.

An original to be copied is read by an original reader not shown. This original reader has a photoelectric conversion element such as CCD for converting an original image into an electric signal to output image signals corresponding to magenta image information, cyan image information, yellow image information and monochrome image information of the original respectively. The LED exposure means (LED array) LE is controlled so as to turn on or off light emitting in response to these image signals for exposing.

The description will be simply made of the sequence of an entire color printer by taking a case of a full-color mode as an example. In this respect, the printer is also capable of printing out an output signal form a computer.

First, the photosensitive drum 3 is rotated in a direction indicated by an arrow, and its surface is uniformly charged by the charger 4. Next, exposures are performed through the use of the LED array LE controlled by a magenta image signal to form a dot-distributed latent image on the photosensitive drum 3. This latent image is reversal-developed by a magenta developing apparatus 1M installed at a developing position in advance to visualize it as a magenta toner image.

Transferring material such as paper is taken out from a cassette C, and is conveyed to a transferring drum 9 through a sheet supply guide 5*a*, a sheet supply roller 6 and a sheet supply guide 5*b*. The transferring material conveyed to the transferring drum 9 is at the tip end held by its gripper 7 to be electro-statically wound around the transferring drum 9 through the use of an abutting roller 8 and its opposite pole.

The transferring drum 9 rotates in synchronism with the photosensitive drum 3 in a direction indicated by an arrow of the figure, and a magenta toner image formed on the photosensitive drum 3 by development by the magenta developing apparatus 1M is transferred onto the transferring material by a transferring charger 10 in the transferring unit in which the photosensitive drum 3 is opposed to the transferring drum 9. The transferring drum 9 continues the rotation as it is to prepare for transfer of the next color image (cyan toner image in the present embodiment).

On the other hand, the photosensitive drum 3 is de-electrified by a charger 11, is cleaned by cleaning means 12, is charged by the charger 4 again, and is exposed through the use of the LED array LE controlled by the next cyan image signal as described above to form an electrostatic latent image. During this period of time, the developing apparatus 1 rotates, the cyan developing apparatus 1C has been installed at a predetermined developing position, and a latent image corresponding to the cyan on the photosensitive drum 3 is reversal-developed to form a cyan toner image. The cyan toner image is superimposed on the magenta toner image on the transferring material conveyed by the transferring drum 9 to be transferred.

The above described process is also performed for yellow and black, and when superposition transferring of toner images for four colors: magenta, cyan, yellow and black has been completed, the transferring material is de-electrified by chargers 13 and 14 located on the inner side and outer side of the transferring drum 9, the grasp by the gripper 7 is released, and is separated from the transferring drum 9 by a separating claw 15. The transferring material thus separated is fed to a thermo-compression roller fixer 17 through the use of a conveying belt 16 so that the superposed toner images of the four colors are fixed.

A series of full-color printing sequence is thus completed, and a desired full-color printed image can be obtained.

The configuration of the present printer shows one example, and various systems can be taken, for example, the charger 3 may be a charging roller in place of the Corona charger, the exposure means may be a semiconductor laser, the transferring charger 7 may be a charging roller. Basically, an image is formed through processes of charging, exposure, developing, transferring and fixing.

Figure 2:
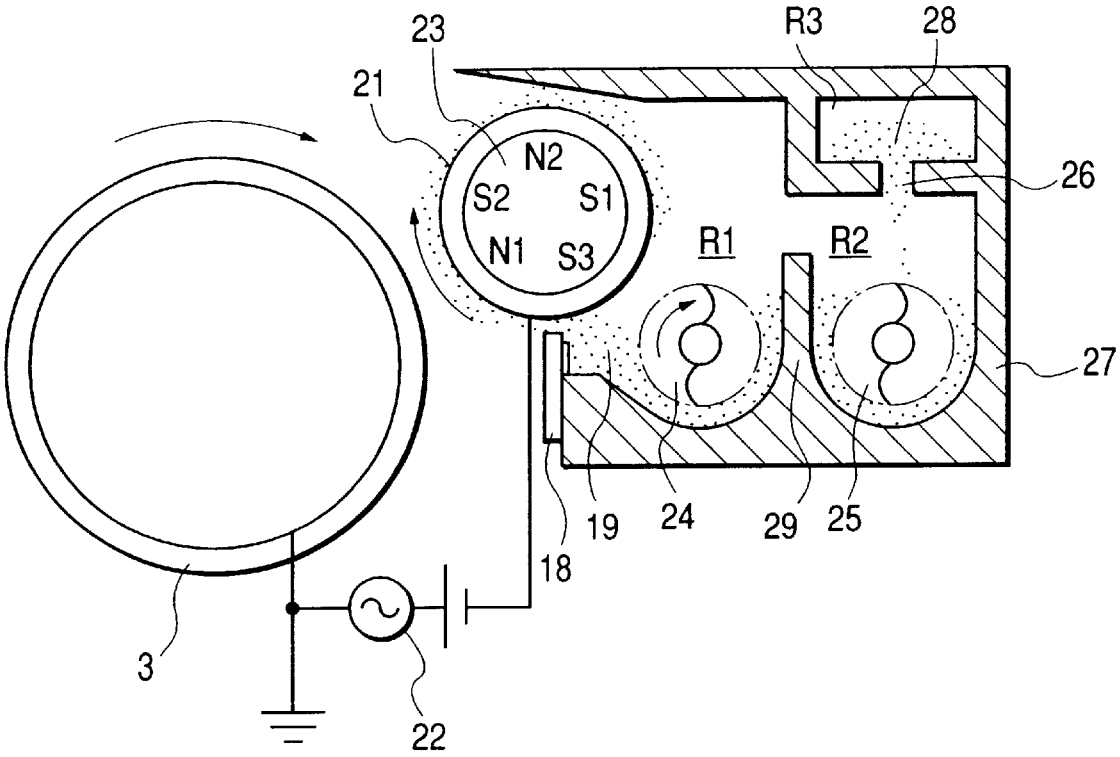
FIG. 2 is a cross sectional view showing a developing apparatus installed in the image forming apparatus of FIG. 1.

The present invention is significantly characterized by a developing apparatus installed in an image forming apparatus. Hereinafter, with reference to the drawing, the description will be made of, for example, the magenta developing apparatus 1M, one of developing apparatuses 1M to 1K provided for the rotational developing apparatus 1 of the present printer. The developing apparatuses 1C, 1Y and 1K are basically configured in the same manner as the developing apparatus 1M. FIG. 2 is a structural view showing the developing apparatus 1M.

The present developing apparatus 1M is, as shown in FIG. 2, provided with a developing container 27, the interior of the developing container 27 is partitioned into a developing chamber (first chamber) R1 and an agitating chamber (second chamber) R2 through the use of a partition wall 29, there is provided a toner storage chamber R3 beyond the partition wall 29 in the upper part of the agitating chamber R2, and replenish toner (non-magnetic toner) 28 is contained within the toner storage chamber R3. The partition wall 29 is provided with a replenish port 26, and replenish toner 28 of an amount corresponding to toner consumed is fallen and replenished into the agitating chamber R2 through the replenish port 26.

The developer 19 is contained within the developing chamber R1 and the agitating chamber R2. The developer 19 is two-component developer consisting of one obtained by adding titanium oxide with average particle diameter of 20 nm by 1% in weight ratio to non-magnetic toner with average particle diameter of 8 $\mu$m produced in accordance with the crushing method, and magnetic carrier with average particle diameter of 35 $\mu$m having a value of magnetization in 100 mm tesla being 270 emu/cm$^3$. The mixing ratio of the developer has been determined such that the non-magnetic toner becomes about 7% in weight ratio.

In a region where the developing container 27 is positioned close to the photosensitive drum 3, there is provided an opening, and a developing sleeve 21 is provided to protrude outwardly from the opening, and this developing sleeve 21 is rotatively installed within the developing container 27. In the present embodiment, the developing sleeve 21 is made of non-magnetic material such as, for example, SUS305AC, and within the developing sleeve 21, there is fixed a roller-shaped magnet, which is magnetic field generating means, that is a magnet roller 23.

The magnet roller 23 has a developing magnetic pole N1, developer layer thickness regulation pole S3 located upstream thereof, and magnetic poles N2, S2 and S1 for carrying the developer, and the magnet 23 is disposed within the developing sleeve 21 such that the developing magnetic pole N1 is opposed to the photosensitive drum 3. The developing magnetic pole N1 forms a magnetic field in the vicinity of the developing unit between the developing sleeve 21 and the photosensitive drum 3, and this magnetic field causes the developer carried to the developing unit with the rotation of the developing sleeve 21 to form a magnetic brush. The developer made into the magnetic brush comes into contact with the photosensitive drum 3 to develop the electrostatic latent image on the photosensitive drum 3. The developing sleeve 21 and the photosensitive drum 3 move in opposite directions (counter directions) to each other within the developing unit in which these are positioned close to each other.

During developing, vibration bias voltage obtained by superposing DC voltage on AC voltage is applied to the developing sleeve 21 as developing bias from power supply 22. A dark portion potential (non-exposure portion potential) and a light portion potential (exposure portion potential) of the latent image are positioned between the maximum value and the minimum value of this vibration bias potential. This forms an alternating electric field for alternately changing the direction in the developing unit, the toner and the carrier vibrate violently in this alternating electric field, the toner tears itself from an electrostatic force of constraint to the developing sleeve 21 and the carrier to fly to the photosensitive drum 3, and the toner of an amount corresponding to the latent image potential adheres to the photosensitive drum 3. In the present embodiment, the dark portion potential of the photosensitive drum is set to −550 V, and the light portion potential is set to −100 V, and vibration bias obtained by superposing DC voltage of −300 V on AC voltage having Vpp of 2.0 kV and frequency Frq of 6 kHz is applied to the developing sleeve as developing bias.

The developer after the developing has been completed in the developing unit is returned into the developing container 27 with the rotation of the developing sleeve 21, and is separated from the developing sleeve 21 by means of a repulsion magnetic field to be formed by magnetic poles S1 and S3 of the magnet roller 23, and is fallen and collected within the developing chamber R1.

Within the developing container 27, a blade 18 is fixed below the developing sleeve 21, is disposed at a predetermined interval therefrom, and in the present embodiment, is spaced apart 400 μm. The blade 18 is made of magnetic material such as iron, and magnetically regulates the layer thickness of the developer borne on the developing sleeve 21.

Within the developing chamber R1, there is installed a conveying screw 24, and in the present embodiment, the conveying screw 24 having diameter of 14 mm was used. The conveying screw 24 is rotated in a direction indicated by an arrow in the drawing, and the rotation of this conveying screw 24 conveys the developer 19 within the developing chamber R1 along the longitudinal direction of the developing sleeve 21.

In the present embodiment, this conveying screw 24 has been disposed below the developing sleeve 21 in the gravitational direction. This is because the top surface of the developer to be housed in the conveying screw 24 is set to between the developer layer thickness regulation pole S3 and a scraping pole S1. The reason for the setting will be described later.

Within the agitating chamber R2, there is provided a conveying screw 25, and in the present embodiment, for the conveying screw 25, a conveying screw with a diameter of 14 mm was used in the same manner as the conveying screw 24. The conveying screw 25 conveys the developer 19 within the agitating chamber R2 along the longitudinal direction of the developing sleeve 21 in an opposite direction to the conveying screw 24 by the rotation thereof, and in the conveying process, the toner 28 replenished from the toner storage chamber R3 is mixed with the developer 19.

The non-magnetic toner used in the present invention will be described. In the present embodiment, non-magnetic toner having amount of frictional charge of about $2.0\times10^{-2}$ C/kg was used.

This toner preferably has an average volume particle diameter of 4 to 15 μm. The average volume particle diameter of the toner is measured by, for example, the following measuring method.

As the measuring device, a coal counter TA-II type (manufactured by Coal Tar Inc.) was used, an interface outputting number distribution and volume distribution (manufactured by NIKKAKI) and CX-i personal computer (manufactured by Canon) were connected. For electrolyte, 1% NaCl aqueous solution was prepared using first class salt.

Toner of test portion is added to the above described electrolyte for mixing, the electrolyte in which the test portion has suspended is dispersed by an ultra sonic dispersion apparatus for one to three minutes, and using a 100 μm aperture by the coal tar cunter TA-II type, particle size distribution of 2 to 40 μm toner particles is measured to determine volume distribution, and the average volume particle diameter of the toner is obtained from the volume distribution.

When the surface of the toner is covered with external admixture, two mechanical effects can be imparted. One of the effects is that fluidity of the toner is improved and the replenish toner can be easily agitated and mixed with two-component developer within the developing container, and the other is that the external admixture lies between on the surface of the toner, whereby the mold release characteristics of the toner developed to the photosensitive drum is improved to enhance the transfer efficiency.

As the external admixture to be used in the present invention, the particle diameter is preferably 1/10 or less the average weight particle diameter of the toner particle in terms of durability when added to the toner. In the present invention, the particle diameter of the external admixture means the average particle diameter obtained from observation of the surface of the toner particle in an electron microscope.

As the external admixture, there are used, for example, metallic oxide (such as aluminum oxide, titanium oxide, titanic acid strontium, cerium oxide, magnesium oxide, chrome oxide, tin oxide and zinc oxide), nitride (such as silicon nitride), carbide (such as silicon carbide), metallic salt (such as calcium sulfate, barium sulfate and calcium carbonate), aliphatic series metallic salt (such as zinc stearate and calcium stearate), carbon black, silica or the like.

These external admixtures are employed, with respect to 100 parts by weight of the toner particle, in an amount of 0.01 to 10 parts by weight, preferably 0.05 to 5 parts by weight. These external admixtures may be independently used, or may be used together in plurality. Those subjected to the hydrophobic treatment respectively are more preferable.

In the present embodiment, toner obtained by adding titanium oxide with average particle diameter of 20 nm by 1% in weight ratio was used.

In the present invention, as magnetic carrier constituting developer by combining with such toner as described above, conventionally known magnetic carrier can be used. There are used, for example, resin carrier formed by dispersing magnetite as magnetic material in resin, and dispersing carbon black in order to make it conductive and adjust the resistance, or carrier obtained by oxidizing and deoxidizing the surface of simple substance of magnetite such as ferrite to adjust the resistance, or carrier obtained by coating the surface of magnetite such as ferrite with resin to adjust the resistance, or the like. The producing method for these magnetic carrier is not particularly limited.

In the present embodiment, as the magnetic carrier, magnetic carrier having average weight particle diameter of 20 to 100 μm, preferably 20 to 70 μm was used.

Next, the detailed description will be made of positional relationship between a developer layer thickness regulation pole S3 of the magnet roller 23 within the developing sleeve 21 used in the present embodiment, a scraping pole S1 for forming a repulsion magnetic field together therewith, and a conveying screw 24 in the vicinity of the developing sleeve 21.

In the present embodiment, the peak value of intensity of magnetic field of pole S3 in a direction perpendicular to the surface of the developing sleeve 21 is preferably 40 mm tesla or more, 100 mm tesla or less, and the peak value of intensity of magnetic field of pole S1 in a direction perpendicular to the surface of the developing sleeve 21 is preferably 40 mm tesla or more, 80 mm tesla or less. In the present embodiment, the peak value of intensity of magnetic field of the pole S3 was set to 60 mm tesla, and the peak value of intensity of magnetic field of the pole S1 was set to 50 mm tesla.

Figure 3:
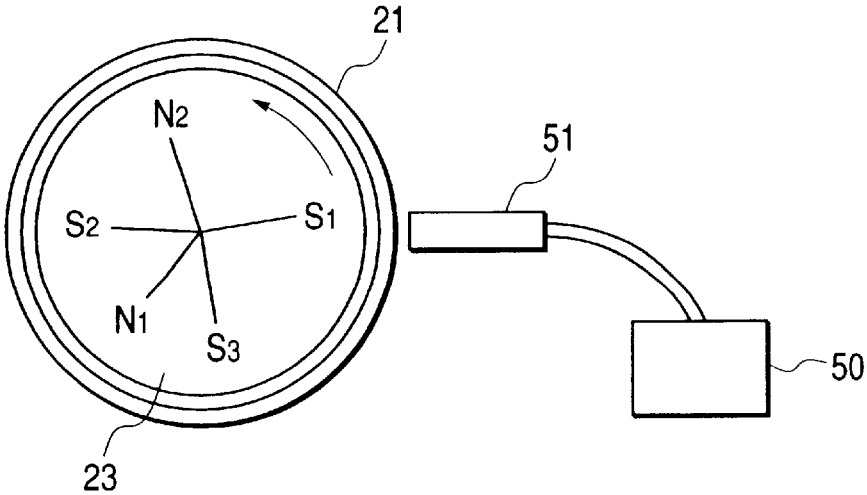
FIG. 3 is an explanatory view illustrating a method for measuring magnetic flux density of a magnet roller within a developing sleeve of the developing apparatus of FIG. 2 in a perpendicular direction.

FIG. 3 shows an example of measuring method for the intensity of magnetic field. FIG. 3 shows the intensity of magnetic field of the developing sleeve 21 in the direction of the normal in a position on the surface of the developing sleeve 21, that is, a measuring method for magnetic flux density Br, and the measurement was performed through the use of a gauss meter (Model 640) of Bell Inc.

In FIG. 3, the developing sleeve 21 is horizontally fixed, and the magnet roller 23 within the developing sleeve 21 is rotatively mounted. An axial probe 51 is fixed spaced apart a very small interval from the developing sleeve 21, 100 μm in the present embodiment, and in such a manner that the developing sleeve 21 and the center of the probe 51 are substantially on a horizontal surface. A gauss meter 50 for measuring magnetic flux density is connected to the probe 51. Since the developing sleeve 21 and the magnet roller 23 are substantially concentric circles, the interval between the developing sleeve 21 and the magnet roller 23 can be considered to be the same everywhere. Therefore, by rotating the magnet roller 23, it is possible to measure magnetic flux density Br in the direction of the normal to the surface of the developing sleeve 21 over the entire peripheral direction thereof.

The positional relationship between the pole S3 and the pole S1 is that the peak position of intensity of magnetic field of the scraping pole S1 in a direction perpendicular to the surface of the developing sleeve 21 is positioned higher in the gravitational direction than the peak position of intensity of magnetic field of the developer layer thickness regulation pole S3 in a direction perpendicular to the surface of the developing sleeve 21.

When such positional relationship is adopted, the developer after development is prone to fall, and it becomes easy to strip the developer off even if any special scraping means is not needed, and it becomes easy to adsorb the developer by magnetic attraction using the developer layer thickness regulation pole S3 for conveying to the developing unit. In other words, a mechanism concerning scraping the developer from the developing sleeve 21 and supply of the developer to the developing sleeve 21 is easily simplified.

The peak position of intensity of magnetic field of the pole S3 in a direction perpendicular to the surface of the developing sleeve 21 and the tip end of the regulating blade 18 on the developing sleeve side forms an opening of an angle of 5° as viewed from the center position of the developing sleeve in the present embodiment.

Since the pole S3 forms a repulsion magnetic field with the pole S1 therebetween, a line of magnetic force of the pole S3 tends to emanate perpendicularly to the developing sleeve 21. As a result, the rate of change in the magnetic field (magnetic flux density) in a direction perpendicular to the developing sleeve becomes small. This means that a force of attracting the developer to the developing sleeve becomes smaller. Therefore, the force, with which the developer is compressed at the developer layer thickness regulation pole S3, is weakened, and deterioration of the developer such as deteriorated toner and spent carrier is restrained to extend the life of the developer.

However, in case of structure, in which one magnetic pole S3 of the repulsion magnetic poles is used as the developer layer thickness regulation pole and the conveying screw 24 is disposed in the vicinity of the regulation pole as in the present embodiment, when the developer surface positioned in the vicinity of the developing sleeve 21 is comparatively low, screw-shaped pitch unevenness occurred at the rear end of the solid black image.

As regards this phenomenon, in the case where the developer with toner density lowered having an image history after the development is not scraped by the repulsion magnetic field, but moves to the developer layer thickness regulation pole S3, when the developer having the image history and developer, which is agitated and conveyed by the conveying screw 24 to be supplied to the regulation pole S3, are mixed, the phenomenon occurs by the mixing ratio being changed in accordance with the rotational period of the screw in the image longitudinal domain.

After various investigations, it has been found out that the distribution form of the lower limit value of intensity of magnetic field in a direction perpendicular to the developing sleeve 21 between the developer layer thickness regulation pole S3 and the scraping pole S1, which form a repulsion magnetic field, is arranged as below, whereby screw pitch-shaped density unevenness is prevented from occurring.

Figure 4:
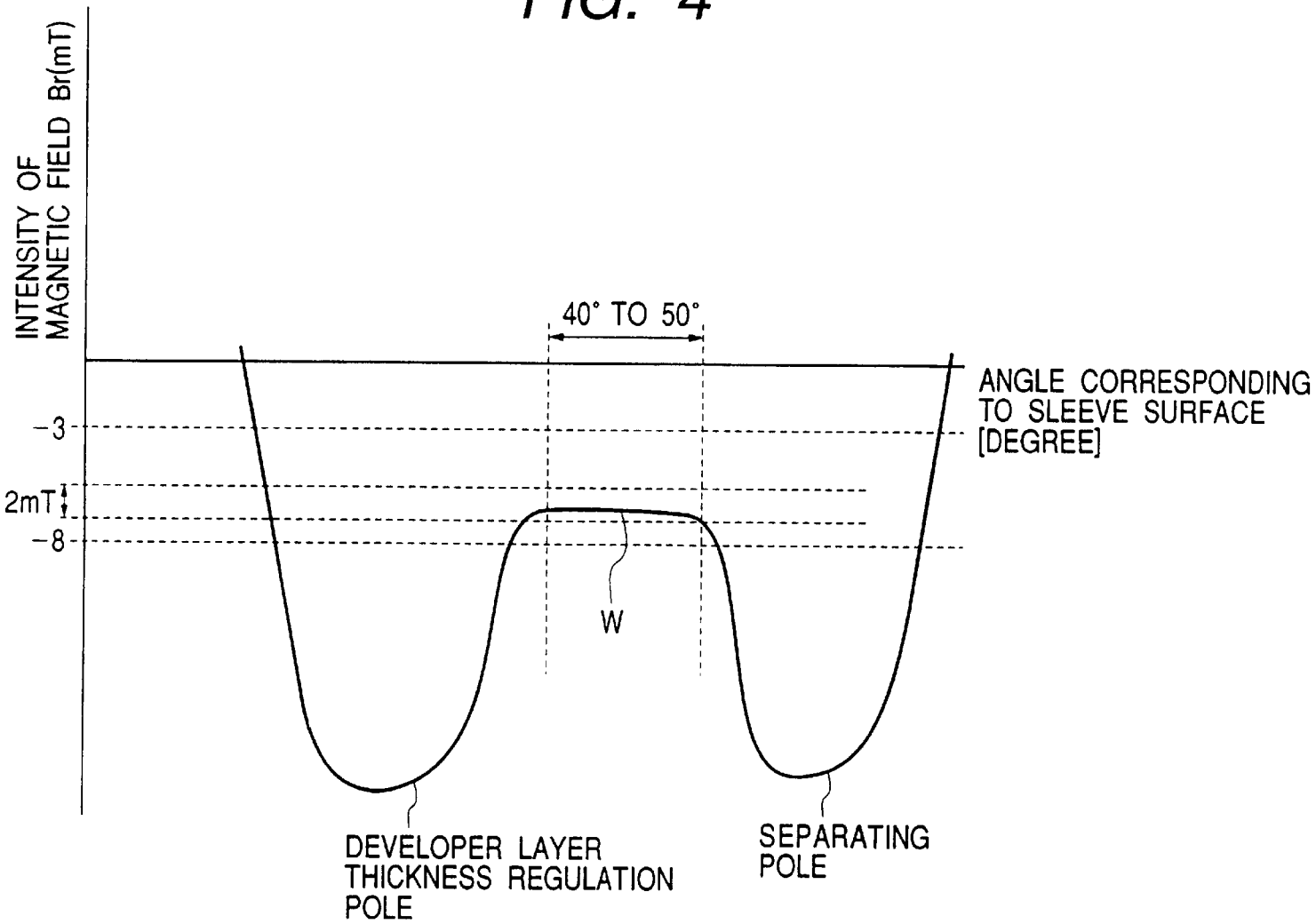
FIG. 4 is an explanatory view illustrating distribution of intensity of magnetic field between and before and behind two magnetic poles constituting repulsion magnetic field of the magnet of FIG. 3.
Figure 5:
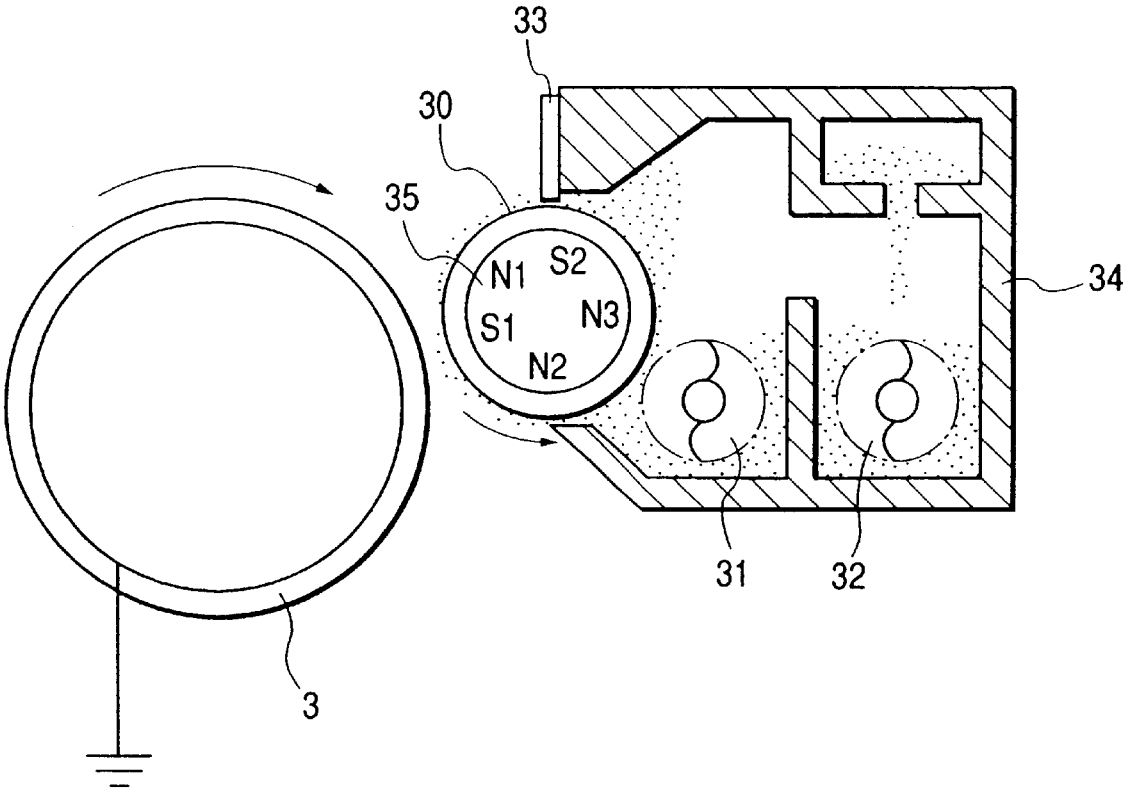
FIG. 5 PRIOR ART
FIG. 5 is a cross sectional view showing a conventional developing apparatus.

More specifically, the lower limit value W of intensity of magnetic field (hereinafter, a reference character Br (unit:millitesla, mT) will be affixed) in a direction perpendicular to the surface of the developing sleeve of the developer layer thickness regulation pole S3 and the scraping pole S1 is, as shown in FIG. 4, the same polarity as magnetic poles S3 and S1 for forming the repulsion magnetic field (in FIG. 4, the intensity Br of magnetic field of a south pole is indicated by a negative value), is distributed over an area of an angle 40 to 50° between the developer layer thickness regulation pole S3 and the scraping pole S1, and the lower limit value W in the distributed area can have an absolute value of 3 to 8 millitesla, and variations of the lower limit value W can be within a range of 2 mm tesla.

In the distributed area of the lower limit value W of the intensity Br of magnetic field, the line of magnetic force emanates substantially perpendicularly to the developing sleeve 21, and if the lower limit value W is substantially the same value within a range of 3 to 8 mm tesla within the distributed area of a range of 40 to 50° as in the present embodiment, the rate of change in the magnetic flux density in a direction perpendicular to the surface of the developing sleeve 21 in the distributed area, can be reduced. Therefore, the force of attracting the developer to the developing sleeve 21 can be reduced, no magnetic attraction force is exerted within the distributed area, but the developer after the development can be completely scraped so that screw-shaped image density unevenness will not be produced.

As regards screw pitch-shaped density unevenness, when particularly the diameter of the developing sleeve is made small, the space distance between the scraping pole S1 and the developer layer thickness regulation pole S3 becomes shorter, therefore it becomes difficult to strip off the developer having image history after the development, and the screw pitch-shaped density unevenness easily occurs. The configuration of the present embodiment is specially effective to prevent screw pitch-shaped density unevenness when the diameter of the developing sleeve is 20 mm or less, preferably 10 mm and over to 20 mm incl.

In the present embodiment, the above described configuration did not cause any screw-shaped density unevenness.

In the present embodiment, the description has been made of the case where the photosensitive drum 3 and the developing sleeve 21 are rotated in counter-directions to each other in the developing unit as shown in FIG. 2, but the present invention is not limited thereto. However, to regulate the developer layer thickness below the developing container 27 in the gravitational direction thereof facilitates configuration so as to reduce the degree of compaction of the developer as in the present developing apparatus (because developer not adsorbed to the developing sleeve exists in the lower part within the container 27 in the gravitational direction). Also, when the transfer unit is located below the photosensitive drum, it simplifies configuration of the developing apparatus to arrange the structure so as to rotate the developing sleeve and the photosensitive drum in counter-directions to each other.

As described above, according to the present embodiment, the structure has been arranged such that the lower limit value of the intensity Br of magnetic field on the surface of the developing sleeve in a direction perpendicular thereto between adjacent magnetic poles having the same polarity constituting repulsion magnetic poles of the magnet within the developing sleeve is distributed over an area of 40° to 50° in the peripheral direction of the developing sleeve at the same polarity as these adjacent magnetic poles, the dispersion in the lower limit value of the intensity Br of magnetic field in the perpendicular direction in the distributed area is within 2 mm tesla, and the absolute value of the lower limit value is 3 to 8 mm tesla. Therefore, even if one pole adjacent to the magnet, having the same polarity is used as the developer layer thickness regulation pole, and magnetization of the magnetic carrier of the two-component developer is reduced to thereby extend the life of the developer, it is possible to prevent screw pitch unevenness on the solid black portion from occurring, and to obtain an uniform image free of unevenness.

In order to explain the effect of the first embodiment, a first comparative example was compared with a second comparative example.

A first comparative example is configured such that in the first embodiment, the lower limit value of the intensity Br of magnetic field on the surface of the developing sleeve in a direction perpendicular thereto between adjacent magnetic poles having the same polarity, for forming a repulsion magnetic field of the magnet within the developing sleeve is distributed over an area of 25° in the peripheral direction of the developing sleeve at the same polarity as these adjacent magnetic poles, and the dispersion in the lower limit value of the intensity Br of magnetic field in the perpendicular direction in the distributed area is within 2 mm tesla, and the absolute value of the lower limit value is 3 to 8 mm tesla.

As a result of performing a development in the configuration of the first comparative example to output an A4-sized solid black image, screw pitch-shaped density unevenness occurred halfway the operation.

A second comparative example is configured such that in the first embodiment, the lower limit value of the intensity Br of magnetic field on the surface of the developing sleeve in a direction perpendicular thereto between adjacent magnetic poles having the same polarity, for forming the repulsion magnetic field of a magnet within the developing sleeve is distributed over an area of 20° in the peripheral direction of the developing sleeve at the same polarity as these adjacent magnetic poles, and the dispersion in the lower limit value of the intensity Br of magnetic field in the perpendicular direction in the distributed area is within 2 mm tesla, and the absolute value of the lower limit value is 0 mm tesla.

As a result of performing a development in the configuration of the second comparative example to output an A4-sized solid black image, screw pitch-shaped density unevenness occurred halfway the operation.

(Second Embodiment)

In the present embodiment, as magnetic carrier in the two-component developer, carrier having magnetization of 150 emu/cm$^3$ in a magnetic field of 100 mm tesla has been used. The other conditions were set to the same as the first embodiment.

A similar configuration to the first embodiment is adopted, one of adjacent magnetic poles having the same polarity constituting repulsion magnetic poles of the magnet within the developing sleeve is used as the developer layer thickness regulation pole, and in the present embodiment, the intensity of magnetization of the magnetic carrier is further reduced. For this reason, compression of the developer at the developer layer thickness regulation pole is weakened to further extend the life of the developer.

When such a configuration is adopted, however, it becomes more difficult than the first embodiment to strip off the developer after the development, and screw pitch-shaped density unevenness easily occurs. When the magnetic carrier is less magnetized, the developer becomes insensitive to the magnetic field, and the developer after the development is prone to move to the developer layer thickness regulation pole.

According to the present invention, as a result of various investigations, the structure has been arranged such that the lower limit value of the intensity Br of magnetic field on the surface of the developing sleeve in a direction perpendicular thereto between adjacent magnetic poles of the developer layer thickness regulation pole and the scraping pole having the same polarity constituting repulsion magnetic poles of the magnet within the developing sleeve is distributed over an area of 40° to 50° in the peripheral direction of the developing sleeve at the same polarity as these adjacent magnetic poles, the dispersion in the lower limit value of the intensity Br of magnetic field in the perpendicular direction in the distributed area is within 2 mm tesla, and the absolute value of the lower limit value is 3 to 8 mm tesla, and further in addition thereto, magnetization of the magnetic carrier in the two-component developer is set to 30 emu/cm$^3$ or more(carrier having magnetization under 30 emu/cm$^3$ cannot be coated on the developing sleeve) and 250 emu/cm$^3$ or less.

According to the present invention, it is possible to obtain an uniform image free of any screw pitch-shaped unevenness in the solid black portion, and to further provide a longer life of the developer.

In the foregoing, the description has been made of embodiments of the present invention, but the present invention is not limited thereto, and modifications of every description can be performed within the technical idea.

What is claimed is:

1. A developing apparatus, comprising:

a developing container containing developer including magnetic carrier and non-magnetic toner;

a developer bearing body provided at an opening of said developer container, for rotating while bearing the developer;

a magnet member provided within said developer bearing body, having a first magnetic pole and a second magnetic pole, wherein the second magnetic pole is adjacent on the downstream side of said developer bearing body of the first magnetic pole in a direction of rotation thereof and has the same polarity as the first magnetic pole; and a regulating member provided in the vicinity of the second magnetic pole, for regulating an amount of developer on said developer bearing body, wherein between the first magnetic pole and the second magnetic pole, there exists 40° or more a lower limit area having 3 to 8 mT in magnetic flux density in the direction of a normal to a surface of said developer bearing body.

2. A developing apparatus according to claim 1, wherein between the first magnetic pole and the second magnetic pole, the magnetic flux density in the direction of the normal to the surface of said developer bearing body substantially constitutes a lower limit, wherein an area of the lower limit having dispersion within 2 mT exists 40° to 50°.

3. A developing apparatus according to claim 1, wherein said regulating member is provided substantially below said developer bearing body.

4. A developing apparatus according to claim 3, wherein said developer bearing body is opposed to an image bearing body for bearing an electrostatic image, and rotates in a counter-direction to said image bearing body in an opposing portion.

5. A developing apparatus according to claim 1, wherein a diameter of said developer bearing body is 10 to 20 mm.

6. A developing apparatus according to claim 1, wherein the magnetic carrier has magnetization of 30 to 200 emu/$cm^3$ in a magnetic field of 100 mT.

7. A developing apparatus according to claim 1, further comprising an agitating screw for agitating developer fallen from between the first and second magnetic poles.

* * * * *